US010471447B2

(12) United States Patent
Baltz et al.

(10) Patent No.: US 10,471,447 B2
(45) Date of Patent: Nov. 12, 2019

(54) CASCADE SYSTEM

(71) Applicant: Carlisle Fluid Technologies, Inc., Charlotte, NC (US)

(72) Inventors: James Paul Baltz, Waterville, OH (US); Andrew James Heldman, Walbridge, OH (US)

(73) Assignee: Carlisle Fluid Technologies, Inc., Scottsdale, AZ (US)

( * ) Notice: Subject to any disclaimer, the term of this patent is extended or adjusted under 35 U.S.C. 154(b) by 199 days.

(21) Appl. No.: 15/227,829

(22) Filed: Aug. 3, 2016

(65) Prior Publication Data

US 2017/0036223 A1 Feb. 9, 2017

Related U.S. Application Data

(60) Provisional application No. 62/201,431, filed on Aug. 5, 2015.

(51) Int. Cl.

| | |
|---|---|
| ***B05B 5/053*** | (2006.01) |
| ***B05B 5/03*** | (2006.01) |
| ***B05B 7/12*** | (2006.01) |

(52) U.S. Cl.

CPC ..... *B05B 5/03* (2013.01); *B05B 5/0531* (2013.01); *B05B 5/0532* (2013.01); *B05B 5/0533* (2013.01); *B05B 7/1209* (2013.01); *B05B 5/0535* (2013.01)

(58) Field of Classification Search

CPC ..... B05B 5/03; B05B 5/0531; B05B 5/0532; B05B 5/0533; B05B 5/0535; B05B 7/1209; B05B 5/00–1691

USPC ..... 239/690–708

See application file for complete search history.

(56) References Cited

U.S. PATENT DOCUMENTS

| | | | | |
|---|---|---|---|---|
| 4,491,276 | A * | 1/1985 | Reeves | F01D 15/062 239/692 |
| 2007/0145167 | A1 | 6/2007 | Howe | |
| 2009/0224075 | A1* | 9/2009 | Altenburger | B05B 5/03 239/526 |
| 2013/0277463 | A1 | 10/2013 | Baltz et al. | |
| 2014/0131486 | A1 | 5/2014 | Wang et al. | |

FOREIGN PATENT DOCUMENTS

| | | | |
|---|---|---|---|
| JP | 2002059034 | A | 2/2002 |
| JP | 2004167411 | A | 6/2004 |
| JP | 2012060790 | A | 3/2012 |

OTHER PUBLICATIONS

PCT International Search Report and Written Opinion; Application No. PCT/US2016/045647; dated Nov. 11, 2016; 13 pages.
Japanese Office Action for JP Application No. 2018-505680 dated Mar. 26, 2019, 13 pgs.

* cited by examiner

*Primary Examiner* — Arthur O. Hall
*Assistant Examiner* — Juan C Barrera
(74) *Attorney, Agent, or Firm* — Fletcher Yoder, P.C.

(57) ABSTRACT

A system includes an electrostatic tool having a cascade that includes electrical components configured to convert a first voltage from an incoming alternating current into an outgoing second voltage at a direct current and a shell configured to cover the electrical components. The shell radially conforms to the electrical components.

17 Claims, 3 Drawing Sheets

CASCADE SYSTEM

CROSS-REFERENCE TO RELATED APPLICATION

This application claims priority to and benefit of U.S. Provisional Patent Application No. 62/201,431, entitled "CASCADE SYSTEM," filed Aug. 5, 2015, which is herein incorporated by reference in its entirety.

BACKGROUND

The present application relates generally to an electrostatic spray tool.

Electrostatic spray tools output sprays of electrically charged materials to more efficiently coat objects. For example, electrostatic tools may be used to paint objects. In operation, the material is charged when it leaves a spray tip of the electrostatic tool and travels toward the object, which is grounded. The grounded target attracts the electrically charged material, which then adheres to an external surface of the grounded target. Unfortunately, the charging mechanism increases the weight of the electrostatic tool, which can cause discomfort for a user.

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment a system includes an electrostatic tool having a cascade that includes electrical components configured to convert an alternating current at a first voltage into a direct current at a second voltage, and a shell configured to electrically isolate the electrical components. The shell conforms to the electrical components.

In another embodiment a system includes a cascade system having an oscillator that includes a first cross-sectional shape, configured to convert a low-voltage alternating current signal to a low-voltage direct current signal, and a transformer having a second cross-sectional shape, configured to convert the low-voltage direct current signal to a high-voltage signal. The cascade also includes a shell having an oscillator end configured to conform to the first cross-sectional shape and a transformer end configured to conform to the second cross-sectional shape.

In another embodiment a system includes an electrostatic tool having a handle portion including an electrical generator and an electric generator air passage, a barrel portion coupled to the handle portion, and a cascade configured to be installed within the barrel portion and to convert a low-voltage alternating current (AC) signal to a high-voltage direct current (DC) signal. The cascade includes interior electrical components, and an exterior shell configured to conform to the shape of the electrical components.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is generally directed to an electrostatic tool system capable of electrically charging a material sprayed with a compressed gas, such as air. More specifically, the disclosure is directed towards an electrostatic charging system having a light-weight cascade system that minimizes space usage and securing material (e.g., potting material). As will be discussed in more detail below, the shell of the cascade fits more securely around the electronic components such that the shell is smaller, and uses less potting material to secure the electronic components within the shell. The shell includes two or more parts so that each end of the shell fits around some or all of the electrical components as explained below. The shell may also be constructed to safely and securely separate wires that propagate voltage between electrical components within the cascade.

Figure 1:
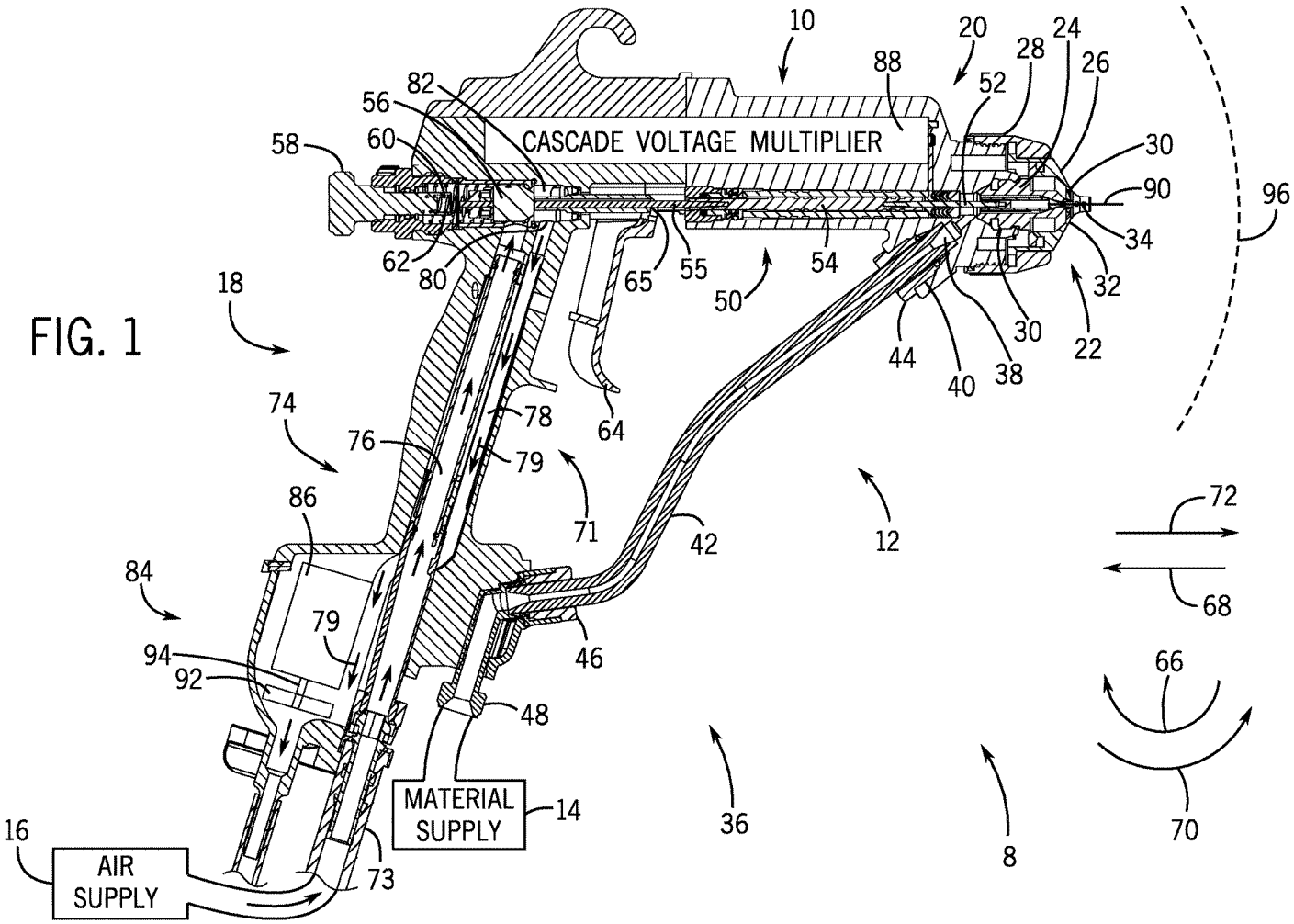
FIG. 1 is a cross-sectional side view of an embodiment of an electrostatic tool system with a cascade system.

FIG. 1 is a cross-sectional side view of an embodiment of a electrostatic tool system 8. As illustrated, the electrostatic tool system 8 includes a cascade system 10 and an electrostatic tool 12 that are configured to electrically charge and spray a material (e.g., paint, solvent, etc.) towards an electrically attractive target. The electrostatic tool 12 receives sprayable material from a material supply 14, which the electrostatic tool 12 sprays with compressed air from an air supply 16. The material supply 14 may be configured to store and supply a liquid and/or powder coating material, such as paint.

As illustrated, the electrostatic tool 12 includes a handle 18, a barrel 20, and a spray tip assembly 22. The spray tip assembly 22 includes a fluid nozzle 24, an air atomization cap 26, and retaining ring 28 (e.g., a threaded ring). The fluid nozzle 24 may be removably inserted into a receptacle 30 of the barrel 20. As illustrated, the air atomization cap 26 covers the fluid nozzle 24, and is removably secured (e.g., threaded) to the barrel 20 with the retaining ring 28. The air atomization cap 26 includes a variety of air atomization orifices, such as a central atomization orifice 30 disposed about a liquid tip exit 32 from the fluid nozzle 24. The air atomization cap 26 may also have one or more spray shaping air orifices, such as spray shaping orifices 34 that use air jets to force the spray to form a desired spray pattern (e.g., a flat spray). The spray tip assembly 22 may also include a variety of other atomization mechanisms to provide a desired spray pattern and droplet distribution.

The electrostatic tool 12 includes a variety of controls and supply mechanisms for the spray tip assembly 22. As illustrated, the electrostatic tool 12 includes a liquid delivery assembly 36 having a liquid passage 38 extending from a liquid inlet coupling 40 to the fluid nozzle 24. Included in the liquid delivery assembly 36 is a liquid tube 42. The liquid tube 42 includes a first tube connector 44 and a second tube connector 46. The first tube connector 44 couples the liquid tube 42 to the liquid inlet coupling 40. The second tube connector 46 couples the liquid tube to the handle 18. The handle 18 includes a material supply coupling 48, enabling the electrostatic tool 12 to receive material from the material supply 14. Accordingly, during operation, the material flows from the material supply 14 through the handle 18 and into the liquid tube 42, where the material is transported to the fluid nozzle 24 for spraying.

In order to control liquid and air flow, the electrostatic tool 12 includes a valve assembly 50. The valve assembly 50 simultaneously controls liquid and air flow as the valve assembly 50 opens and closes. The valve assembly 50 extends from the handle 18 to the barrel 20. The illustrated valve assembly 50 includes a fluid nozzle needle 52, a shaft 54, and an air valve needle 55 which couples to an air valve 56. The valve assembly 50 movably extends between the liquid nozzle 24 and a valve adjuster 58. The valve adjuster 58 is rotatably adjustable against a spring 60 disposed between the air valve 56 and an internal portion 62 of the valve adjuster 58. The valve assembly 50 is also coupled to a trigger 64 at point 65, such that the fluid nozzle needle 52 of the valve assembly 50 may be moved inwardly away from the fluid nozzle 24 as the trigger 64 is rotated in a clockwise direction 66. More specifically, rotation of the trigger 64 in a clockwise direction 66 moves the valve assembly 50 in direction 68 retracting the fluid nozzle needle 52 to an open position, enabling fluid to flow into the fluid nozzle 24. Similarly, when the trigger 64 rotates in a counter-clockwise direction 70, the fluid nozzle needle 52 moves in direction 72 sealing the fluid nozzle 24 and blocking further fluid flow.

An air supply assembly 71 is also disposed in the electrostatic tool 12, enabling atomization at the spray tip assembly 22 with compressed air from the air supply 16. The illustrated air supply assembly 71 extends from an air inlet 73 to the spray tip assembly 22 through an air passage 74 to the air atomization cap 26. The air passage 74 includes multiple air passages including a main air passage 76 and an electric generator air passage 78. As mentioned above, the valve assembly 50 controls fluid and air flow through the electrostatic tool 12 through movement of the trigger 64. As the trigger 64 rotates in a clockwise direction 66, the trigger 64 opens the air valve 56. More specifically, rotation of the trigger 64 in a clockwise direction 66 induces movement of the air valve 56 in direction 68 through movement of the air valve needle 55. As the air valve 56 moves in direction 68, the air valve 56 unseats from the sealing seat 80, enabling air to flow from the main air passage 76 into an air plenum 82. The air plenum 82 communicates with and facilitates airflow from the main air passage 76 into the electric generator air passage 78.

In contrast, when the trigger 64 rotates in a counter-clockwise direction 70, the air valve 56 moves in direction 68 resealing with the sealing seat 80. Once the air valve 56 reseals with the sealing seat 80, air is unable to travel from the air supply 16 through the main air passage 76 and into the air plenum 82, for distribution into electric generator air passage 78. Accordingly, activation of the trigger 64 enables simultaneous liquid and airflow to the spray tip assembly 22. Indeed, once an operator pulls the trigger 64, the valve assembly 50 moves in direction 68. The movement of the valve assembly 50 in direction 68 induces the fluid nozzle needle 52 to retract from the fluid nozzle 24, enabling fluid to enter the fluid nozzle 24. Simultaneously, movement of the valve assembly 50 induces the air valve 56 to unseat from the sealing seat 80, enabling air flow through the main air passage 76 and into the air plenum 82. The air plenum 82 then distributes the air for use by the spray tip assembly 22 (i.e., to shape and atomize) and by the power assembly 84.

The power assembly 84 includes an electric generator 86, the cascade system 10, and an ionization needle 90. As explained above, the air plenum 82 enables air flow to distribute into an electric generator air passage 78. The electrical generator air passage 78 directs airflow 79 from the air plenum 82 back through the handle 18 and into contact with a turbine (e.g., a plurality of blades) or fan 92. The airflow induces the turbine 92 to rotate a shaft 94. The electrical generator 86 converts the mechanical energy from the rotating shaft 94 into electrical power for use by the cascade system 10. The cascade system 10 is an electrical circuit, which converts low voltage alternating current (AC) (e.g., 40,000 V) from the electrical generator 86 into high voltage direct current (DC) (e.g., 65,000 V). The cascade system 10 outputs the high voltage direct current to the ionization needle 90, which then creates an ionization field 96 that electrically charges atomized liquid sprayed by the electrostatic tool 12. As will be explained in detail below, the cascade system 10 includes smaller and therefore lighter components that use less potting and protect wires.

Figure 2:
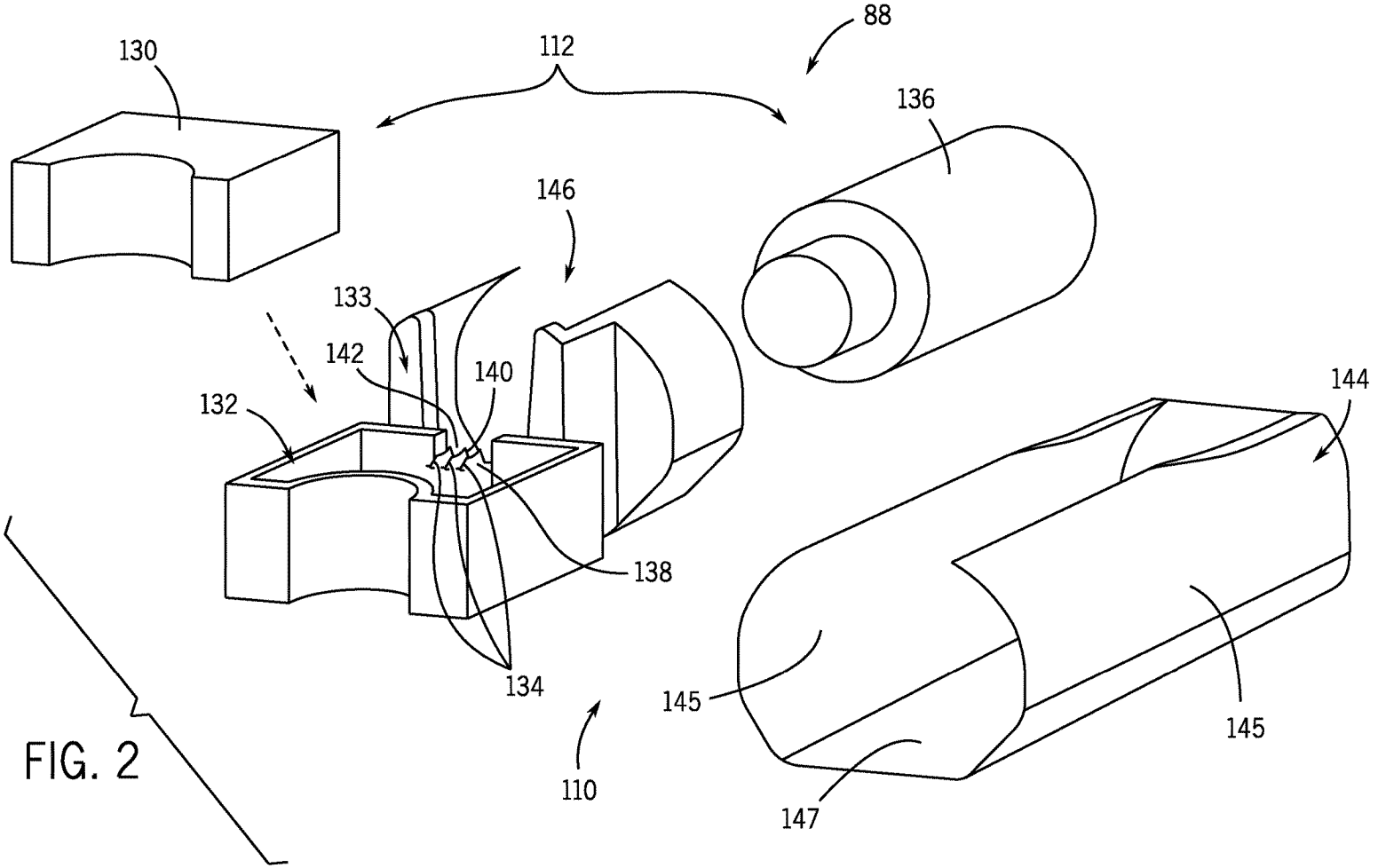
FIG. 2 is an exploded view of the cascade system shown in FIG. 1.

FIG. 2 is an exploded view of an embodiment of the cascade system 10 of FIG. 1. The cascade system 10, in some embodiments, may be replaceable or otherwise include a self-contained unit that is installed within the barrel 20. The cascade system 10 includes a shell 110 that contains the electrical components 112. The electrical components 112 may include capacitors, resistors, diodes, semiconductors, and/or other electrical connections that convert the low voltage AC signal from the electrical generator 86 to the high voltage DC signal that is output to the nozzle tip assembly 22. Specifically, the electrical components 112 include an oscillator 130 located at a first end 132 of the cascade system 10. As illustrated, the oscillator 130 may include a rectangular shape and rest within a rectangular first shell portion 133. Other shapes may be used as well. The oscillator 130 converts the AC signal to a DC signal that is then transferred through wires 134 to a transformer 136. The wires 134 can be delicate and electrical interference may occur if one wire 134 is too close to another wire 134. To block the wires 134 from touching one another, the shell 110 may include an edge 138 that has a pattern of saw-teeth 140 (e.g., protrusions) and channels 142 receiving one of the wires 134. For example, the channels 142 may correspond to a plurality of parallel spaces along an external surface, wherein the protrusions 140 define intermediate parallel walls or divides between the spaces. In some embodiments, the wires 134 may be spaced apart by holes (e.g., bores or passages) drilled into the shell 110, with each hole receiving a separate wire 134.

Figure 3:
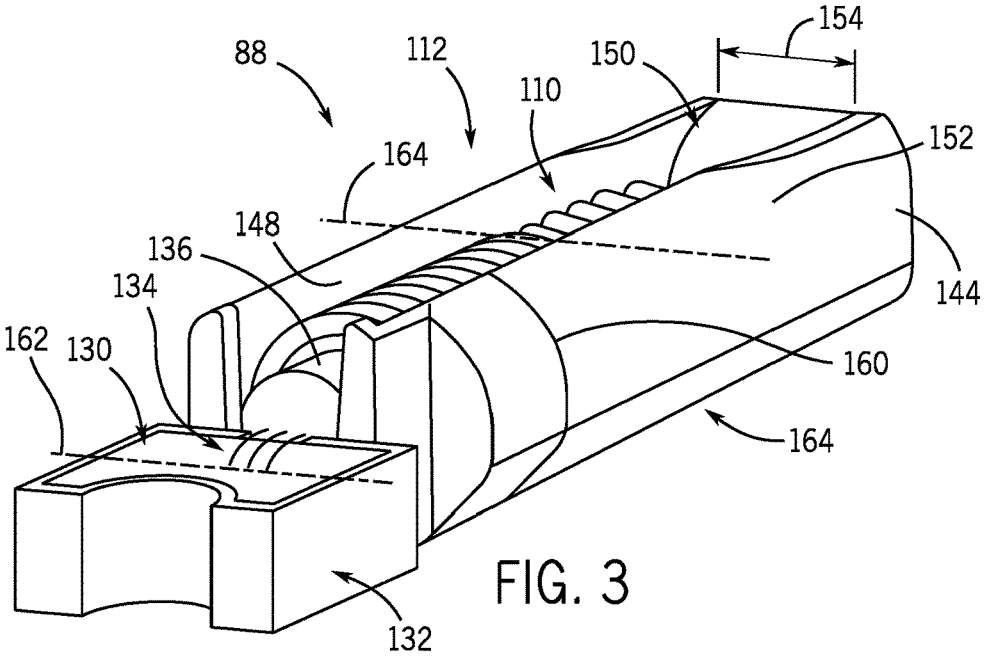
FIG. 3 is a perspective view of an embodiment of the assembled cascade system of FIG. 2.

In operation, the transformer 136 receives the DC signal from the oscillator 130 through the wires 134 and converts the signal from a low voltage to a high voltage. In order to protect the transformer 136, the shell 110 includes a second shell portion 144. Splitting the shell 110 into a first shell portion 133 and a second shell portion 144 enables the shell 110 to surround at least some of the electrical components 112 (e.g., transformer 136) from either longitudinal end. As illustrated, the second shell portion 144 has a rounded cross-sectional shape that conforms to the cross-sectional shape of the transformer 136. The rounded cross-sectional shape may include rounded walls 145 and/or flat walls 147 to match the shape of the transformer 136 or other electrical components 112 that may be housed within the shell 110. Conforming the shape of the second shell portion 144 to the transformer shape means that the interior of the second shell portion 144 is the same or substantially the same as the exterior of the transformer 136. The conforming shapes may allow for some variations, such as a deviation of less than or equal to 1, 2, 3, 4, 5, 6, 7, 8, 9, 10, or 15 percent between the shapes of the inner and outer perimeters (or cross-sectional shapes). The shell 110 contains and protects the transformer 136 by conforming to the first shell portion 133 with a second shell portion 144. The first shell portion 133 includes a second end 146 that has a round shape that conforms to the shape of the transformer 136. As shown in FIG. 3, the first shell portion 133 and the second shell portion 144 couple together with the transformer 136 inside between them.

FIG. 3 is a perspective view of an embodiment of the assembled cascade system of FIG. 2. As explained above, the shell 110 surrounds and conforms to the shape of the components 112 while reducing the size of the shell 110 and thus reducing the weight of the cascade system 10. Moreover, because the shell 110 conforms to the shape of the transformer 136, the shell 110 reduces a distance 148 between the shell 110 and the electrical components 112. For example, the distance 148 between the shell 110 and the transformer 136 may be less than 5 mm, 4 mm, 3 mm, 2 mm, or 1 mm. Minimizing the distance 148 thus reduces the size and weight of the shell 110. While the illustrated embodiment includes a transformer 136 that is round, other embodiment may include electrical components that are shaped differently, such as square, rectangular, oval, or other shapes. For each shape of electrical components 112, the shell 110 may conform to the shape, so that a gap distance 148 is kept. The shell 110 may include a different shape for different electrical components 112, whiles conforming to the shape of the components 112. In the illustrated embodiment, for instance, the first end 132 of the shell 110 includes a rectangular shape to conform to the oscillator 130 while a second end 144 includes a rounded shape to conform to the transformer 136.

As illustrated, the shell 110 does not completely surround the transformer 136, but includes an opening 150 in an upper side 152 of the shell 110. The opening 150 enables potting to be placed with the shell 110 to secure and electrically isolate the electrical components 112 (e.g., oscillator 130 and transformer 136) from the barrel 20. The potting may include glue, an adhesive, an epoxy, or other material that secures and electrically insulates the components 112 within the shell 110. In the illustrated embodiment the potting secures the oscillator 130 within the first end 132 at a first horizontal level 162 of potting, and secures the transformer 136 within the second part 146 at a second horizontal level 164 of potting. Customizing the level of potting to conform to specific electrical components 112 reduces the amount of potting used to secure the components 112 and decreases the cost and the weight of the cascade system 10. Furthermore, because the shell 110 includes two parts (e.g., first shell portion 133 and second shell portion 144) the opening 150 may be customized and thus smaller than the electrical components 112. Specifically, a width 154 of the opening 150 may be smaller than a diameter 156 of the electrical components 112. To accommodate assembly of the cascade system 10, the shell 110 may include two parts divided by a split 160. The first shell portion 162 may or may not correspond to the first end 132, and likewise for the second shell portion 164 and the second end 144. Dividing the shell 110 into the first shell portion 162 and the second shell portion 164 may also have benefits for the molding process (e.g., forming the shell 110).

Figure 4:
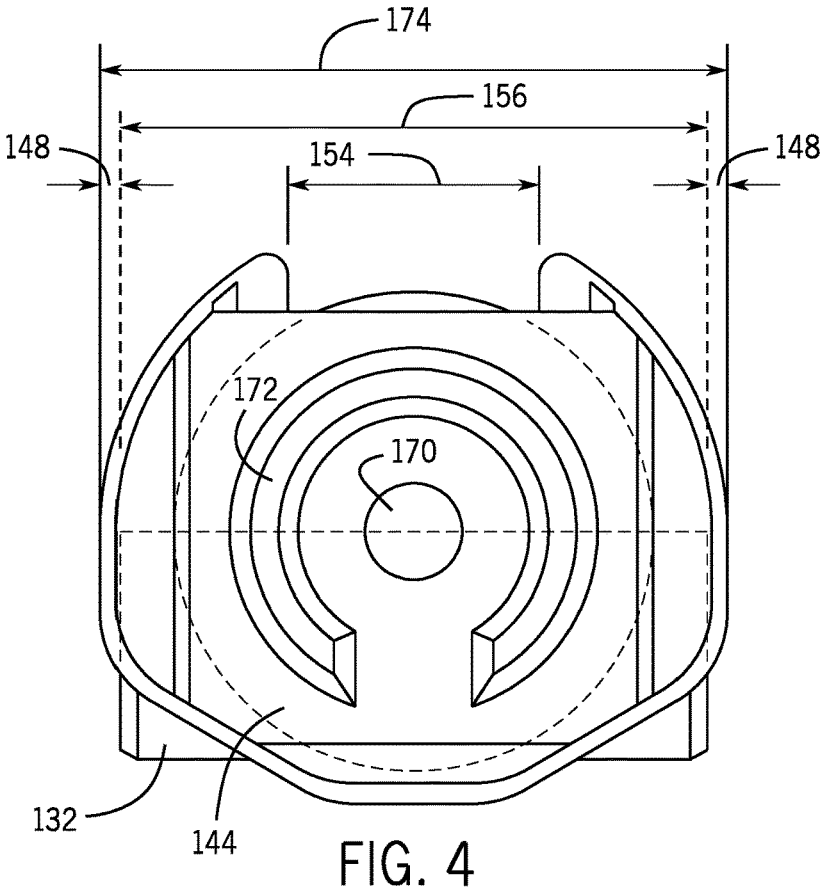
FIG. 4 is an end view of an embodiment of the cascade system of FIG. 2.

FIG. 4 is an end view of the cascade system 10 in FIGS. 1 and 2. The end view is from the second end 144 and shows a conductive button 170 that electrically couples to the nozzle tip assembly 22 shown in FIG. 1. The conductive button 170 may be secured by a securing rim 172. FIG. 3 illustrates that the first end 132 and the second end 144 do not always have the same shape. That is, one end may be rounded (e.g., the second end 144 in the foreground of FIG. 3) while the other end may be square (e.g., the first end 132 in the background of FIG. 3). Potential dimensions of the cascade system 10 are also apparent in FIG. 3. In the illustrated embodiment, an outer diameter 174 of the shell 110 is larger than either the diameter 156 of the components 112 or the width 154 of the opening 150. In certain embodiments, the opening width 154 may be equal to the diameter 174 of the shell 110. In other embodiments, the opening width 154 may be 90 percent, 80 percent, 70 percent, 60 percent, 50 percent, or less of the length of the outer diameter 174 of the shell 110. As explained above, the opening 150 is smaller to enable the shell 110 to conform to the shape of the electrical components 112 and reduce an amount of potting that is used to secure the components 112 to the shell 110.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising: an electrostatic spray tool, comprising: a cascade system, comprising: electrical components comprising: an electrical generator, wherein the electrical components are configured to convert an alternating current at a first voltage into a direct current at a second voltage; and a transformer comprising a first cross-sectional geometry; and a shell comprising an interior having a second cross-sectional geometry comprising a plurality of rounded walls of an upper portion of the shell, wherein the shell is configured to electrically isolate the electrical components, and wherein a first shape of the first cross-sectional geometry of the transformer and a second shape of each rounded wall of the plurality of rounded walls of the interior upper portion of the shell match with one another such that the shell conforms to the transformer wherein the first shape of the first cross-sectional geometry of the transformer and the second shape of each rounded wall of the plurality of rounded walls of the interior upper portion of the shell each comprise a matching radius of curvature.

2. The system of claim 1, wherein the shell comprises a first shell piece and a second shell piece configured to assemble together to conform to a contour of the electrical components.

3. The system of claim 2, wherein the first shell piece comprises a first end configured to receive an oscillator.

4. The system of claim 3, wherein the first shell piece comprises a second end configured to couple to the second shell piece to surround the transformer.

5. The system of claim 4, wherein the second end comprises a longitudinal opening configured to be smaller than a diameter of the transformer.

6. The system of claim 1, wherein the shell is configured to have a gap distance between the plurality of rounded walls and the transformer that is 5 mm or less.

7. The system of claim 1, comprising a saw-tooth pattern along an edge of the shell configured to separate wires.

8. The system of claim 1, wherein the cascade system comprises a cascade configured to be installed within a barrel portion of the electrostatic tool and to convert a low-voltage alternating current (AC) signal to a high-voltage direct current (DC) signal.

9. A system, comprising: a cascade system comprising one or more electrical components, the electrical components comprising: an oscillator, wherein the oscillator is configured to convert a low-voltage alternating current signal to a low-voltage direct current signal; a transformer comprising a first cross-sectional geometry, wherein the transformer is configured to convert the low-voltage direct current signal to a high-voltage signal; and a shell comprising an interior having a second cross-sectional geometry comprising a plurality of rounded walls of an upper portion of the shell, and wherein a first shape of the first cross-sectional geometry of the transformer and a second shape of each rounded wall of the plurality of rounded walls of the interior upper portion of the shell are configured to match one another wherein the first shape of the first cross-sectional geometry of the transformer and the second shape of each rounded wall of the plurality of rounded walls each comprise a matching radius of curvature.

10. The system of claim 9, comprising wires configured to transfer the low-voltage signal from the oscillator to the transformer, wherein the wires are separately disposed in a plurality of channels on an edge of the shell.

11. The system of claim 9, wherein a first height of an oscillator end of the shell is at least 10 percent smaller than a second height of a transformer end of the shell.

12. The system of claim 9, wherein the shell is configured to have a gap distance between the plurality of rounded walls and the transformer that is 5 mm or less.

13. The system of claim 12, wherein a first shell piece comprises an oscillator end of the shell and at least a part of a transformer end of the shell, and a second shell piece comprises a remaining part of the transformer end of the shell.

14. The system of claim 13, wherein the first shell piece splits longitudinally from the second shell piece, and the first shell piece and the second shell piece are configured to longitudinally fit over the transformer.

15. A system, comprising: an electrostatic tool comprising: a handle portion including an electrical generator and an electric generator air passage; a barrel portion coupled to the handle portion; and a cascade configured to be installed within the barrel portion and to convert a low-voltage alternating current (AC) signal to a high-voltage direct current (DC) signal, wherein the cascade comprises: interior electrical components comprising a transformer, wherein the transformer comprises a first cross-sectional geometry; and an exterior shell comprising an interior having a second cross-sectional geometry comprising a plurality of rounded walls of an upper portion of the shell, wherein a first shape of the first cross-sectional geometry of the transformer and a second shape of each rounded wall of the plurality of rounded walls of the interior upper portion of the shell match with one another, such that the exterior shell conforms to a shape of the transformer wherein the first shape of the first cross-sectional geometry of the transformer and the second shape of each rounded wall of the plurality of rounded walls of the interior each comprise a matching radius of curvature.

16. The system of claim 15, wherein the exterior shell is configured to maintain a gap distance between the exterior shell and the interior electrical components that is 5 mm or less.

17. The system of claim 16, wherein the shell comprises a saw-tooth pattern along an edge of the shell configured to separate wires.

* * * * *